US005112715A

United States Patent [19]

DeMejo et al.

[11] Patent Number: 5,112,715

[45] Date of Patent: May 12, 1992

[54] TONER COMPOSITIONS CONTAINING A MULTI-PURPOSE ADDITIVE

[75] Inventors: Lawrence P. DeMejo, Rochester; John M. McCabe, Pittsford; John C. Wilson, Rochester, all of N.Y.

[73] Assignee: Eastman Kodak Company, Rochester, N.Y.

[21] Appl. No.: 563,011

[22] Filed: Aug. 6, 1990

[51] Int. Cl.[5] ..... G03G 9/087

[52] U.S. Cl. ..... 430/109; 430/110; 430/137

[58] Field of Search ..... 430/110, 109, 137; 525/119

[56] References Cited

U.S. PATENT DOCUMENTS

| | | | |
|---|---|---|---|
| 4,507,376 | 3/1985 | Makita et al. | 430/109 |
| 4,575,478 | 3/1986 | Ohno | 430/109 |
| 4,693,952 | 9/1987 | Koizumi et al. | 430/109 |
| 4,837,393 | 6/1989 | Alexandrovich et al. | 430/110 |
| 4,837,394 | 6/1989 | Alexandrovich et al. | 430/110 |
| 4,840,863 | 6/1989 | Otsu et al. | 430/110 |
| 4,921,913 | 5/1990 | Pettit | 525/119 |

FOREIGN PATENT DOCUMENTS

| | | |
|---|---|---|
| 1131489 | 9/1914 | Canada . |
| 0317367 | 11/1988 | European Pat. Off. . |

*Primary Examiner*—John Goodrow

*Attorney, Agent, or Firm*—Dressler, Goldsmith, Shore, Sutker & Milnamow, Ltd.

[57] ABSTRACT

Low fusing temperature toner compositions with good keep and broad fusing latitude characteristics are provided. The toner compositions are the reaction product of a linear or branched carboxylated polyester crosslinked with an epoxy novolac resin utilizing a multi-purpose additive as a catalyst for the crosslinking reaction and as a charge control agent for the toner powder.

3 Claims, No Drawings

TONER COMPOSITIONS CONTAINING A MULTI-PURPOSE ADDITIVE

FIELD OF THE INVENTION

This invention is in the field of toner compositions of linear or branched carboxylated polyester resins crosslinked with multifunctional epoxy resins. A multi-purpose additive is utilized that is a catalyst for the crosslinking reaction and a charge control agent for the toner composition.

BACKGROUND OF THE INVENTION

In the electrophotography art, there is a need for relatively low fusing temperature toner powders having adequate offset latitude and good keeping performance. These toners are desirable because they permit a copier to operate at lower internal temperatures which increases the useful life of machine components in the copier such as the photoconductor films, electronic components, fuser roll and the like. These toners also reduce power consumption, copier warmup time, and problems with paper receivers and permit higher speed fusing.

To achieve such results, various approaches have been tried. One approach has been to utilize crosslinking monomers such as divinyl benzene in styrene/acrylic systems. However, this type of toner fuses at fairly high temperatures, nearly 400° F., which can adversely affect the fusing subsystem and adjacent components in the copier.

Blends of high molecular weight polymers have been shown to provide good offset latitude for low fusing temperatures. However, these materials are difficult to manufacture because the polymers have very different viscosities and do not melt-blend easily.

U.S. Pat. No. 4,217,406 discloses toners that use polymers that are crosslinked during meltkneading. Unfortunately, many of these polymers cannot be practically manufactured because the kinetics of the crosslinking reaction are too slow. If the reaction is too rapid, the material can degrade if processing continues for too long of a time period.

So far as is now known, the prior art approaches have not solved the problem of providing a toner powder with low fusing temperatures and adequate offset latitude.

SUMMARY OF THE INVENTION

This invention relates to toner compositions comprising a linear or branched carboxylated polyester resin that is crosslinked with a multifunctional epoxy resin and a multi-purpose additive and methods for producing the toner compositions.

This toner composition comprises a low molecular weight linear or branched polyester with acid functionality, a multifunctional epoxy resin, and additives which act both as catalysts for the epoxy crosslinking as well as charge agents for the toner. The low molecular weight and chemical composition of the polyester results in a low fusing temperature, excellent grindability and the appropriate glass transition temperature ($T_g$) for good keeping performance of the toner powders. The low level of crosslinking with the epoxy resin gives good offset latitude. The catalysts chosen allow attainment of crosslinking equilibrium in an extruder, rapidly, but without degradation upon completion of reaction.

The present invention also relates to a process for making a toner powder utilizing a melt reactor that provides conditions conducive to the crosslinking reaction.

Various other features, advantages, aims, purposes, embodiments and the like of this invention will be apparent to those skilled in the art from the present specification and appended claims.

DETAILED DESCRIPTION OF THE PREFERRED EMBODIMENTS

The toner compositions of this invention comprise a low molecular weight carboxylated polyester resin crosslinked with a multifunctional epoxy novolac resin and a multi-purpose additive that is a catalyst for the crosslinking reaction and a charge control agent for the toner compositions. The toner compositions can be ground to produce toner powders.

The polyester has an acid content of about 0.1 to about 0.7 meq/g, preferably from about 0.18 to about 0.3 meq/g, of acid functionality. The number average molecular weight is in the range of about 1,000 to about 4,000, preferably from about 1,500 to about 3,000. The weight average molecular weight is in the range of about 2,000 to about 15,000, preferably from about 3,000 to about 10,000. The polyester has a glass transition temperature ($T_g$) in the range of about 50° C. to about 85° C., preferably from about 60° C. to about 75° C.

As those skilled in the art will appreciate, the polyester can have many structures depending upon such variables as the monomers used for polycondensation and the condensation conditions employed. For example, the presence of a suitable molar excess of polyhydroxylated compound can be used to regulate the number of reactable hydroxyl groups per molecule in a polyester. All, or a chosen portion, of the hydroxyl groups can then be reacted (carboxylated) with a polycarboxylic acid anhydride to achieve a quantity of reactable carboxyl groups per molecule. Suitable acid anhydrides are preferably aromatic and preferably contain at least two carboxyl groups per molecule when in the hydrated (or acid) form. Examples of suitable anhydrides include pyromellitic dianhydride, trimellitic anhydride, phthalic anhydride, 3,3',4,4'-benzophenonetetracarboxylic dianhydride, glutaric anhydride, succinic anhydride, maleic anhydride, and the like. The carboxylation reaction of a polyester with such an acid anhydride is conveniently carried out at elevated temperature under liquid phase conditions.

Tri or tetra functional carboxylic acids can also be employed for condensation with diols using conditions which result in polyesters that contain a desired quantity of reactable carboxyl groups per molecule.

One presently preferred class of polyesters comprises:

about 50 to about 99 mole percent terephthalic acid;

about 0 to 49 mole percent additional diacid(s);

about 1 to about 15 mole percent trimellitic anhydride;

about 50 to about 100 mole percent neopentyl glycol; and 0 to about 50 mole percent 1,4-cyclohexanedimethanol.

It should be noted that mole percents for the polyacid components are based upon total polyacid components and glycol mole percents are based upon total glycol components.

The term "glass transition temperature," as used in its various grammatical forms, identifies the temperature at which a polymer changes from a glassy state to a rubbery state. The glass transition temperature can be measured by differential thermal analysis as disclosed in "Techniques and Methods of Polymer Evaluation," Vol. 1, Marcel Dekker, Inc., NY 1966.

The term "keep" or "keeping" as used herein in relation to a toner powder means the storage stability of the toner powder (i.e., its ability to retain its original particle size distribution when stored in a cartridge at a specified range of temperature and RH conditions). An accelerated keep best measures the ability of the toner to retain its fine powder flow characteristics. A small amount of toner is added to a cylindrical glass vial. A cylindrical weight is placed over the packed toner layer (to simulate the toner at the bottom of a cartridge) and the vial is placed in an oven for a set period of time at a set temperature. Toner keep is controlled by the glass transition temperature or softening point of the toner. The keep is subjectively evaluated by removing the toner from the vial after the incubation period and determining its powder characteristics by applying some pressure to the packed powder. If it retains its original powder form without applying any pressure or with slight pressure it rates good to excellent. A fair keep indicates that some pressure is required to break up the clump. Poor and fused keep ratings indicate partial or total sintering of the packed powder.

Representative commercially available polyester resins are Cargill 3000 polyester resin and Cargill 3018 polyester resin, both from Cargill, Carpentersville, Ill.

The low molecular weight epoxy novolac resin has about 2 to about 6 epoxide groups per molecule.

The term "epoxy novolac resin" as used herein means an epoxy resin made by the reaction of epichlorohydrin with a novolac resin. An epoxy novolac resin has the pendant repeating epoxide structure:

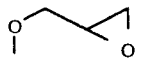

A novolac resin is a condensate of a phenol compound with formaldehyde in the presence of acid catalysts. The phenol compound can be phenol itself, or such compounds as the cresols, xylenols, resorcinol, naphthols, and the like. Epoxy novolac resins used in the practice of this invention have epoxy functionalities which are typically in the range of about 2.5 to about 6.

One presently preferred class of epoxy novolac resins comprises epoxy cresol novolac resins having a molecular weight in the range of about 500 to about 1,300. These resins are prepared by the condensation of cresol and formaldehyde followed by reaction with epichlorohydrin to produce a polymer having an epoxy functionality in the range of about 2.5 to about 6.

An example of a presently particularly preferred epoxy cresol novolac resin is characterized by the structure:

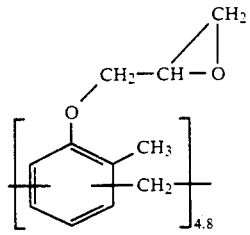

This epoxy resin is obtainable from Ciba-Geigy Corp. under the trade designation "ECN 1273" and has an epoxy functionality of about 4.8.

A multi-purpose additive that is a catalyst for the crosslinking reaction and a charge control agent for the toner composition is utilized in the production of the toner compositions of the present invention. The multi-purpose additive causes rapid completion of the crosslinking reaction, but does not degrade upon completion of the crosslinking reaction.

Representative multi-purpose additives include 2-imidazolines, imidazoles, benzimidazoles, unsubstituted and substituted triphenylphosphonium tosylates, substituted phosphines, the like and mixtures thereof.

2-Imidazolines may be represented by the following general structure:

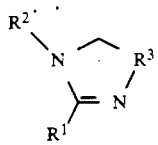

where $R^1$ is aromatic and substituted aromatic, such as phenyl, 2-chlorophenyl, 2-hydroxyphenyl, 4-chlorophenyl, 4-methylphenyl, and the like, alkyl, such as undecyl and the like, aralkyl, such as benzyl and the like, or hydrogen;

$R^2$ is hydrogen or alkyl, such as methyl and the like;

$R^1$ together with $R^2$ may be alkylene, such as 1,3-propylene, 1,5-pentylene, and the like; and $R^3$ is alkylene, such as methylene, 1,2-ethylene, isopropylidene and the like.

Imidazoles and benzimidazoles may be represented by the following general structure:

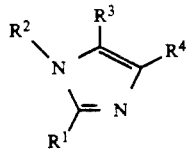

where $R^1$ is aromatic, such as phenyl;

$R^2$ is alkyl, such as methyl;

$R^3$ is hydrogen;

$R^4$ is hydrogen;

$R^1$ together with $R^2$ may form a six membered ring system, such as when $R^1+R^2$ is —CH=CH—CH=CH—; and $R^3$ together with $R^4$ may form a six membered ring system, such as when $R^3+R^4$ is —CH=CH—CH=CH—.

The triphenylphosphnoium tosylate can be substituted with a straight or branched chain $C_1$ to about $C_8$ alkyl group, e.g., methyl, ethyl, tert-butyl, hexyl, octyl, an the like and mixtures thereof.

The phosphine is substituted with at least one aromatic group such as a phenyl group.

Representative 2-imidazolines include:

2-phenyl-2-imidazoline;
2-(2-hydroxyphenyl)-2-imidazoline;
2-(2-chlorophenyl)-2-imidazoline;
2-(4-chlorophenyl)-2-imidazoline;
2-(4-methylphenyl)-2-imidazoline;
2-n-undecyl-2-imidazoline;
2-benzyl-2-imidazoline;
4,4-dimethyl-2-imidazoline;
1,5-diazabicyclo [4.3.0] non-5-ene; and
1,8-diazobicyclo [5.4.0] undec-7-ene.

Representative imidazole and benzimidazole compounds include:

1-methyl-2-phenylbenzimidazole and
imidazo [1,2-a] pyridine.

Representative tosylates and phosphines include methyltriphenylphosphonium tosylate, hexyltriphenylphosphonium tosylate, triphenylphosphine, the like and mixtures thereof.

The multi-purpose additive is present in an amount in the range of about 0.25 to about 3.0 weight percent based on the total weight of the toner composition.

The polyester resin and the epoxy novolac resin are utilized in amounts sufficient to achieve the desired crosslinking. If the degree of crosslinking is too high or too low the offset latitude is too narrow or the fusing temperature can be too high.

The components of the toner composition of the present invention can be melt-blended prior to introduction into a melt reactor by admixing at conditions that do not cause the crosslinking reaction to proceed. The crosslinking reaction can be performed in the melt reactor.

Suitable melt reactors include single and twin screw extruders, roll mills, mixers and the like that subject the components of the toner composition to elevated pressure and temperatures.

Representative melt reactors include Brabender Plasticorder mixers, Werner-Pfleiderer twin screw extruders and the like.

The time period required to complete the crosslinking reaction and produce the toner composition is dependent upon the pressure and temperature at which the crosslinking reaction is performed.

The toner composition can be ground into a toner powder using a conventional apparatus such as a Trost TX air pulverizer.

The present Examples are provided by way of representation, and not limitation, of the preferred embodiments of the present invention. In the Examples, the percent of soluble polymer in the toner powder, the fusing temperature, the offset latitude and the keep were determined in accordance with the procedures described herein.

The following Examples are presented by way of representation, and not limitation, of the preferred embodiments of the present invention.

EXAMPLE 1

Preparation of 2-Imidazolines 2-(2-Chlorophenyl)-2-imidazoline was prepared by the method of Isagulyants, et al., Khimiya Geterotsiklicheskikh Soedinenii, No. 3, pp. 383–5, March, 1972.

Methyl o-chlorobenzoate (85.3 g, 0.50 mol) was added to a mixture of 150.25 g(2.50 mol) of ethylenediamine and 25.59 g of DOWEX 50W-X8, H+ form, 20–50 mesh cation exchange resin over approximately 5 mins. The mixture was then heated in a 115° C. bath for 5 hrs, cooled and filtered. After washing the ionexchange resin with methanol, the filtrate was concentrated on a steam bath with water aspirator vacuum and then heated in a 220° C. bath for 1.5 hr with vacuum to remove water. The residue was dissolved in methylene chloride, filtered, and concentrated. The residue was distilled (bp=145°–190° C./1.7–2.0 mm). The crystalline distillate was recrystallized from acetonitrile to give 17.6 g of product; mp=76°–79° C.

Anal. Calcd. for $C_9H_9ClN_2$: C, 59.8; H, 5.0; Cl, 19.6; N, 15.5; Found: C, 59.4; H, 5.1; Cl, 20.5; N, 15.3;

The structure was confirmed by NMR and MS. Other 2-imidazolines were prepared in a similar manner.

EXAMPLE 2

Toner Powder Prepared Utilizing Vitel Polyester Resin And Hexyltriphenylphosohonium Tosylate A toner powder was prepared by melt-blending 100.0 g of Vitel VPE6159A, a low molecular weight polyester resin prepared from terephthallic acid, neopentyl glycol and trimellitic anhydride that is commercially available from Goodyear, 5.6 g of ECN 1273, an epoxy creosol novolac resin commercially available from Ciba-Geigy, 6.0 g of the multi-purpose additive hexyltriphenylphosphonium tosylate and 2.0 g of Regal 300, a carbon black commercially available from Cabot Company, in an 8" roll mill for 10 minutes at a temperature of 100° C. The melt-blend was then introduced into the mixing bowl of a Brabender Plasticorder mixer and reacted for 10 minutes at a temperature of 240° C. using a blade rotational speed of 90 revolutions per minute (rpm).

EXAMPLE 3

Toner Powder Prepared Utilizing Cargill 3000 And Hexyltriphenylphosphonium Tosylate A toner powder was prepared from 60.0 g of Cargill 3000, a polyester resin commercially available from Cargill, Inc., Carpentersville, Ill., 1.80 g of ECN 1273, 1.23 g of the multi-purpose additive hexyltriphenylphosphonium tosylate, and 3.67 g of Regal 300 using the process of Example 2.

EXAMPLE 4

Toner Powder Prepared Utilizing Cargill 369 3000 And 2-Phenyl-2-imidazoline A toner powder was prepared from 60.0 g of Cargill 3000, 1.80 g of ECN 1273, 0.60 g of the multipurpose additive Hardener B-31 (2-phenyl-2-imidazoline which is commercially available from hüls Chemische Werke) and 3.67 g of Regal 300 using the process of Example 2.

EXAMPLE 5

Toner Powder Prepared Utilizing Cargill 3018 And 2-Phenyl-2-imidazoline

A toner powder was prepared from 60.0 g of Cargill 3018, a polyester resin commercially available from Cargill, Inc., 1.80 g of ECN 1273, 1.22 g of Hardener B-31 and 3.67 g of Regal 300 using the process of Example 2.

EXAMPLE 6

Toner Powder Prepared Utilizing Cargill 3000, 2-Phenyl-2-imidazoline And Hexyltriphenylphosphonium Tosylate A toner powder was prepared from 60.0 g of Cargill 3000, 1.80 g of ECN 1273, 0.61 g of Hardener B-31 (2-phenyl-2-imidazoline), 0.61 g of hexyltriphenylphosphonium tosylate, 3.67 g of Regal 300 using the process of Example 2 modified by operating the Brabender Plasticorder mixer at a temperature of 160° C.

EXAMPLE 7

Preparation Of A Triphenyl Phosphine Admixture

A triphenyl phosphine (TPP) admixture of 5.0 g of the multi-purpose additive triphenylphosphine and 45.0 g of Cargill 3000 was prepared by admixing at a temperature of 100° C. for a time period of 10 minutes. The TPP admixture facilitated the weighing of small amounts of triphenylphosphine.

EXAMPLE 8

Toner Powder Prepared Utilizing Cargill 3000 And TPP Admixture

A toner powder was prepared from 59.1 g of Cargill 3000, 1.80 g of ECN 1273, 1.00 g of the TPP admixture of Example 7 and 3.67 g of Regal 300 using the process of Example 6.

EXAMPLE 9

Toner Powder Prepared Utilizing Cargill 3000, 2-Phenyl-2-imidazoline And TPP Admixture A toner powder was prepared from 60.0 g of Cargill 3000, 1.98 g of ECN 1273, 0.61 g of Hardener B-31 (2-phenyl-2-imidazoline), 3.00 g of the TPP admixture from Example 7 and 3.67 g of Regal 300 using the process of Example 2.

EXAMPLE 10

Toner Powder Prepared Utilizing Cargill 3018 And 2-Phenvl-2-imidazoline

A toner powder was prepared from 60.0 g of Cargill 3018, 1.86 g of ECN 1273, 0.60 g of Hardener B-31 (2-phenyl-2-imidazoline) and 3.67 g of Regal 300 using the process of Example 2.

EXAMPLE 11

Toner Powder Prepared Utilizing Cargill 3018 And 2-(2-Hydroxyphenyl)-2-imidazoline A toner powder was prepared from 60.0 g of Cargill 3018, 1.86 g of ECN 1273, 0.60 g of the multipurpose additive 2-(2-hydroxyphenyl)-2-imidazoline and 3.67 g of Regal 300 using the process of Example 2.

EXAMPLE 12

Toner Powder Prepared Utilizing Cargill 3018 And 2-(4-Methylphenyl)-2-imidazoline A toner powder was prepared from 60.0 g of Cargill 3018, 1.86 g of ECN 1273, 0.60 g of the multipurpose additive 2-(4-methylphenyl)-2-imidazoline and 3.67 g of Regal 300 using the process of Example 2.

EXAMPLE 13

Toner Powder Prepared Utilizing Cargill 3018 And 2-(2-Chlorophenyl)-2-imidazoline A toner powder was prepared from 60.0 g of Cargill 3018, 1.86 g of ECN 1273, 0.60 g of the multipurpose additive 2-(2-chlorophenyl)-2-imidazoline and 3.67 g of Regal 300 using the process of Example 2.

EXAMPLE 14

Toner Powder Prepared Utilizing Cargill 3018 And 2-(4-Chlorophenyl)-2-imidazoline A toner powder was prepared from 60.0 g of Cargill 3018, 1.86 g of ECN 1273, 0.60 g of the multipurpose additive 2-(4-chlorophenyl)-2-imidazoline and 3.67 g of Regal 300 using the process of Example 2.

The toners of Examples 2 to 6 and 8 to 14 were evaluated by laying-down patches at transmission optical density of 1.0–1.2 on Husky bond paper and fusing with a Silverstone fusing roll in a fusing device at various temperatures. The fused sample was then creased with a hard roller, opened flat, and rubbed with a gum eraser covered with Kleenex tissue to remove any loose toner. The width of the crack was then compared to a set of crack standards. The crack standards go from excellent down to unfused in steps of e(excellent), g(good), f(fair), p(poor), and unfused. The temperature at which the fused toner achieved a rating of "f" was called the fusing temperature. The offset latitude was given as the temperature range from the lowest temperature at which the crack width matched a standard described as "fair" to the temperature at which hot offset occurred (i.e. some of the toner stuck to the fusing roll) or to 425° F., the highest temperature at which the fuser could operate.

An additional performance evaluation was that of keeping. A sample of the toner was placed in a small glass vial, and a metal weight placed on top of the toner. The sample was kept in a 52° C. oven for three days. After cooling the sample it was removed from the vial and the ease of breaking-up the toner powder into loose particles was evaluated. The range of this test was from totally fused toner to excellent (no loss of flowability of the original powder). Commercial toners range from P(poor) to E(excellent) in this test.

The final toner was mixed with tetrahydrofuran, and the percent of soluble polymer was determined. This value was used as a measure of the extent of crosslinking.

The results of these tests are set forth in the following Table 1.

TABLE 1

| Example | % of Sol. Polymer in Toner | Fusing Temp. °F. | Offset Latitude °F. | Keep |
|---|---|---|---|---|
| 2 | 43.0 | >450 | — | G |
| 3 | 69.8 | 350 | >100 | G– |
| 4 | 82.6 | 310 | >115 | F |

TABLE 1-continued

| Example | % of Sol. Polymer in Toner | Fusing Temp. °F. | Offset Latitude °F. | Keep |
|---|---|---|---|---|
| 5 | 79.4 | 300 | >125 | G |
| 6 | n/a | 340 | >85 | G |
| 7 | 78.4 | 325 | >100 | G+ |
| 8 | 80.1 | 300 | >125 | G |
| 9 | 84.7 | 310 | >125 | F |
| 10 | 76.9 | 300 | >125 | F |
| 11 | 82.6 | 315 | >125 | F |
| 12 | 84.9 | 300 | >125 | F+ |
| 13 | 86.9 | 315 | >125 | F |

Example 2 uses too high a level of crosslinking (low % soluble polymer) and shows a fusing temperature which is too high to be useful.

A fusing temperature of <360° F. and an offset latitude of >50° F. is defined as acceptable for this invention.

We claim:

1. Toner compositions comprising a linear or branched carboxylated polyester resin having an acid content of about 0.1 to about 0.7 milliequivalents based upon hydronium ion weight per gram that is crosslinked with a multifunctional epoxy novolac resin and a multipurpose additive that is a catalyst for the crosslinking reaction and a charge control agent for the toner composition.

2. The toner compositions in accordance with claim 1 wherein the multi-purpose additive is selected from the group of 2-phenyl-2-imidazoline;
2-(2-hydroxyphenyl)-2-imidazoline;
2-(2-chlorophenyl)-2-imidazoline;
2-(4-chlorophenyl)-2-imidazoline;
2-(4-methylphenyl)-2-imidazoline;
2-n-undecyl-2-imidazoline;
2-benzyl-2-imidazoline;
4,4-dimethyl-2-imidazoline;
1,5-diazabicyclo [4.3.0] non-5-ene;
1,8-diazobicyclo [5.4.0] undec-7-ene;
1-methyl-2-phenylbenzimidazole;
imidazo [1,2-a] pyridine;
methyltriphenylphosphonium tosylate;
hexyltriphenylphosphonium tosylate; and
triphenylphosphine.

3. A method of producing crosslinked toner compositions comprising the step of reacting a linear or branched carboxylated polyester resin, a polyfunctional epoxy novolac resin and a multi-purpose additive that is a catalyst for the crosslinking reaction and a charge control agent for the toner composition in a melt reactor at a temperature in the range of about 160° to 240° C. for a period of about 10 minutes.

* * * * *